US005468165A

United States Patent [19]

Weber et al.

[11] Patent Number: 5,468,165

[45] Date of Patent: Nov. 21, 1995

[54] GRASS AND DEBRIS EXCLUSION PLATE FOR MARINE JET PUMPS

[75] Inventors: David R. Weber, Belleair; Christopher S. Clark, Indian Rocks Beach, both of Fla.

[73] Assignee: D. R. Weber, Inc., Belleair, Fla.

[21] Appl. No.: 305,256

[22] Filed: Sep. 13, 1994

[51] Int. Cl.[6] ..... B63H 11/01

[52] U.S. Cl. ..... 440/46; 440/38

[58] Field of Search ..... 440/38, 46, 47; 244/53 B; 114/270, 173; 60/221, 222

[56] References Cited

U.S. PATENT DOCUMENTS 3,757,728 9/1973 Rhoda ..... 60/221
4,373,919 2/1983 Strangeland ..... 440/47

FOREIGN PATENT DOCUMENTS 0110593 7/1982 Japan ..... 440/38
4243687 8/1992 Japan ..... 440/46

*Primary Examiner*—Edwin L. Swinehart
*Attorney, Agent, or Firm*—Dominik & Stein

[57] ABSTRACT

A passive anti-clogging device for feeding water into marine jet pumps, which displaces the laminar flow around the trailing surfaces of the intake port, such that foreign debris and grass are precluded from clogging the intake to the jet pump. The primary component of the invention comprises an exclusion plate that is placed in, or immediately below the intake port, and affixed to the breadth of, or becoming a part of, the trailing edge of the intake port, leaving an opening, or slot, between the exclusion plate and ride plate, or bottom of the vessel, which, when at rest, allows the passage of water only from its anterior and lateral extents, thereby excluding the flow of water into the device from directly below or behind the plate. The edge of the exclusion plate angles or curves from a forward central point or apex to a back point at the trailing edge of the intake port, providing a fair surface to resist laminar attachment of debris, marine vegetation or other debris.

15 Claims, 6 Drawing Sheets

GRASS AND DEBRIS EXCLUSION PLATE FOR MARINE JET PUMPS

BACKGROUND OF THE INVENTION

1. Field of the Invention

This invention relates to marine jet drives. More particularly, this invention relates to devices for ducting water into the jet drive pump providing motive forces for a marine vessel while excluding large debris from entering the intake duct and preventing fibrous debris from clogging the intake duct.

2. Description of the Background Art

Presently there exist devices, generally referred to as marine jet pumps, for ducting water into a pump that produces motive forces for a marine vessel. Jet pumps may be of axial or radial configuration and may be mounted inboard or outboard. Jet propulsion principles involve picking up stationary water, bringing the water up to vessel speed, and forcing the water out an opening or nozzle at the stern of the vessel at a velocity sufficient to produce positive thrust by reaction.

Jet propulsion systems have distinct advantages over other conventional methods in that they provide efficient propulsion without the necessity of bulky components projecting below the craft into the water flow such as propellers, struts, drive trains and steering systems. Thus, jet drive crafts may operate in very shallow water and are much less likely to be damaged by underwater obstructions. Vectored thrust on such craft not only provide directional control, but also allows for reversal of thrust without mechanical reversal of the drive shaft. In addition to being simply and easily maintained, jet drive craft are safer because there are no exposed moving parts to pose a threat to swimmers near or under the stern of the vessel.

The principal drawback of jet drive is that they rely on a clean, unobstructed flow of water to the intake duct in the bottom of the craft or drive unit, which allows not only the intake of water, but also allows the ingestion of any objects which may be floating on or in the water, or objects or marine growth just below the surface. Upon introduction of foreign objects such as seaweed, grass, marine growth, or similar material, some material is simply macerated by the pump and expelled with the discharge water. However, other material becomes lodged in or around the intake duct depending on the craft's disposition and velocity. Larger solid objects such as fragments of wood may become lodged in the intake duct or continue through the duct until they come in contact with the impeller, resulting in possible damage to the impeller and/or drive components. Thus, introduction of foreign material can cause degradation of performance or complete jet drive failure, due to the interruption of water flow and resultant impeller cavitation and/or physical damage to the pump impeller or its components.

While many devices, active and passive, have previously been proposed as a means for preventing clogging at the intake openings of marine jet propulsion pumps, none have proven entirely successful. Typically, a variety of simple screens or grills with a number of coplanar rods or fins parallel to water flow positioned over or in the intake duct, are being utilized to deflect debris and prevent the ingestion of larger objects that could damage the pump. However, ribboned, stranded, or filamentary debris including seaweed, grass and other marine growth becomes entrained, draped and wedged in and on the longitudinal members and the posterior faces of these devices. Held by compression, friction and laminar water flow, this debris continues to accumulate causing interruption of water flow to the impeller and inevitable pump cavitation, degradation of performance, and/or complete system failure.

Therefore, it is an object of this invention to provide an improvement which overcomes the aforementioned inadequacies of the prior art devices and provides an improvement which is a significant contribution to the advancement of the marine jet pump art.

Another object of this invention is to provide a debris exclusion device for excluding debris from the jet intake of a jet drive of a watercraft, the jet intake having an opening defined by front, rear and opposing side portions, the debris exclusion device comprising in combination: an exclusion plate having a forward portion, a rearward portion and opposing side portions; and means for coupling the rearward portion of the exclusion plate relative to a rearward portion of the intake of the jet drive such that the exclusion plate is positioned about the intake of the jet drive with the forward portion and the side portions of the exclusion plate being positioned spaced apart from the forward and the side portions of the jet intake, respectively, whereby, upon operation of the jet drive and forward movement of the watercraft, a positive pressure is created interiorly of the exclusion plate that produces a flow of water about the coupling means thereby precluding an accumulation of debris about the coupling means.

Another object of this invention is to provide an exclusion device as set forth in the preceding object, wherein the coupling means comprises means for coupling the rearward portion of the exclusion plate relative to the rearward portion of the jet intake to define a transverse wall extending from the exclusion plate to the opening of the jet intake with the flow of water flowing about the transverse wall.

Another object of this invention is to provide an exclusion device as set forth in the preceding objects, wherein the exclusion plate is positioned either substantially parallel to and offset from the opening of the jet intake or substantially planar with the opening of the jet intake.

Another object of this invention is to provide an exclusion device as set forth in the preceding objects, wherein the forward portion of the exclusion plate comprises an apex portion and wherein the side portions of the exclusion plate comprises either substantially curved, straight or arcuate configurations.

Another object of this invention is to provide a method for excluding debris from clogging an opening to an intake of a jet drive of a watercraft, comprising the steps of positioning an exclusion plate spaced about the opening and, upon operation of the jet drive and forward movement of the watercraft, producing a positive flow of water through the rearward space between the exclusion plate and the opening, thereby precluding an accumulation of debris at the rearward space.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a passive anti-clogging device for feeding water into marine jet pumps, which displaces the laminar flow around the trailing surfaces of the intake port, such that foreign debris is precluded from clogging the intake to the jet pump. The primary component of the invention comprises an exclusion plate that is placed in, or immediately below the intake port, and affixed to the breadth of, or becoming a part of, the trailing edge of the intake port, leaving an opening, or slot, between the exclusion plate and ride plate, or bottom of the vessel, which, when at rest, allows the passage of water only from its anterior and lateral extents, thereby excluding the flow of water into the device from directly below or behind the plate. The edge of the exclusion plate angles or curves from a forward central point or apex to a back point at the trailing edge of the intake port, providing a fair surface to resist laminar attachment of debris, marine vegetation or other debris.

Debris which comes into contact with the exclusion plate may be simply swept away, or may enter the device and pass through to the jet pump to be macerated by the action of the impeller and is discharged harmlessly with the exhaust water. Debris which enters the device, but does not pass through to the pump, generally comprised of ribboned, stranded, or filamentary debris including seaweed, grass and other vegetation, have a tendency to collect at the outer extents of the exclusion plate at slow speeds. However, as the vessel increases speed, water pressure in the impeller duct increases due to the ram effect of water anterior the intake, and the volume of water entering the device exceeds the demand of the pump. Since more water is entering the device than the pump can use, water is trapped between the intake duct and the exclusion plate, and a lateral flow of unused water is induced. Inasmuch as the structure is such as to allow free transverse area above the plate forward of the impeller duct, with an opening at its lateral extents, the excess water entering the device is forced to move outward, coincidentally creating water flow and a scrubbing action in the area where the debris has collected, and a continuous cleaning action occurs at both sides of the plate.

Depending on the particular application, a central web may be provided for coupling of the exclusion plate to the bottom of the vessel, or drive plate. Furthermore, fins or vanes may be provided at laterally spaced intervals to preclude the passage of larger objects. Fins are desirable, and may be necessary for the structural integrity of the exclusion plate and for precluding the passage of large articles. The fins may also enhance the axial flow into the device. However, the fins are not necessarily component to the primary hydrodynamic principles on which the invention is based.

The parameters within which the invention will function vary from vessel to vessel. The size, the shape, the optimal transverse entry angle, and the vertical placement of the exclusion plate vary with engine power, propulsion unit configuration and capacity, as well as vessel size, speed and hull configuration. Various changes and modifications are possible without departing from the spirit and general scope of the invention including, but not limited to: the longitudinal, lateral and vertical size of the exclusion plate; the shape of the exclusion plate; the vertical placement of the exclusion plate in respect to the bottom of the vessel or ride plate; the vertical placement of the exclusion plate in respect to the impeller duct; the angle of the exclusion plate in respect to the plane of the bottom of the vessel or ride plate; and the inclusion or exclusion of longitudinal fins.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1A:
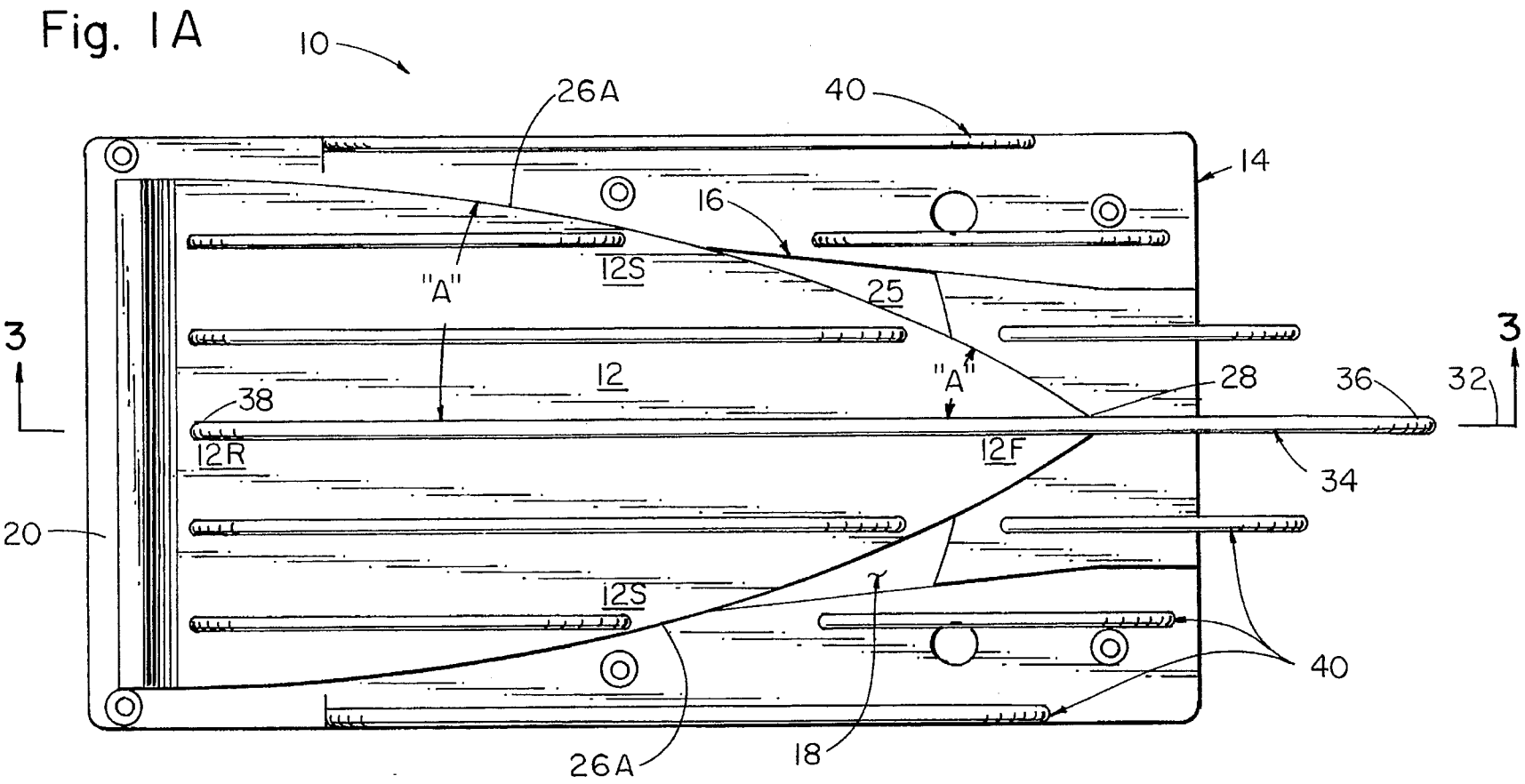
FIG. 1A is a bottom plan view of the first embodiment of the jet drive exclusion device of the invention illustrating the first embodiment of the arcuately-shaped exclusion plate mounted to, but spaced apart from, a ride plate affixed to the underside of the jet drive watercraft about the intake port thereof and illustrating the central web and the plurality of lateral fins positioned in front of an laterally of the exclusion plate.

Referring to FIG. 1A, the invention comprises a jet drive exclusion device, generally indicated by the numeral 10. The device 10 comprises an exclusion plate 12 and a ride plate 14. The ride plate 14 includes an intake hole 16. The exclusion plate 12 is positioned over the intake hole 16 of the ride plate 14. The ride plate 14 is dimensioned and configured to be mounted to the underside of the jet drive watercraft 22 about the intake port 18 of jet intake 24 thereof (see also FIG. 3). As described in greater detail hereinafter, the device 10 comprises two embodiments; one in which the exclusion plate 12 is positioned in a spaced-apart configuration parallel to the ride plate 14 (see FIGS. 1A–C, 2 & 3) and another in which the exclusion plate 12 is positioned substantially planar with the ride plate 14 in the intake hole 16 thereof (see FIG. 4). Further, there exists three embodiments of the exclusion plate 12 itself (see FIGS. 1A, 1B & 1C) that may be incorporated into either embodiment of the device 10.

Figure 1B:
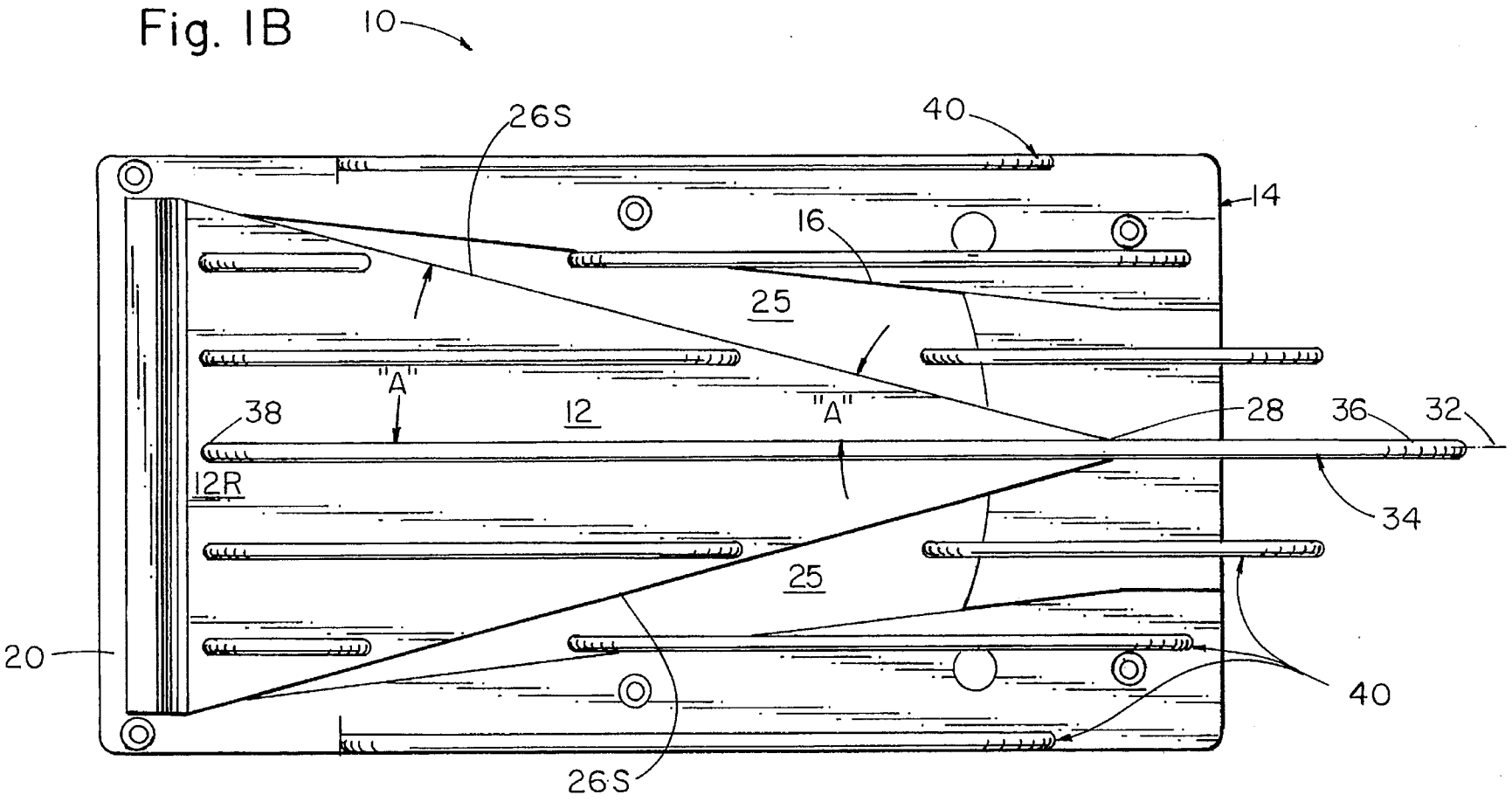
FIG. 1B is a bottom plan view of the second embodiment of the exclusion plate wherein the exclusion plate comprises a generally straight-side configuration.
Figure 1C:
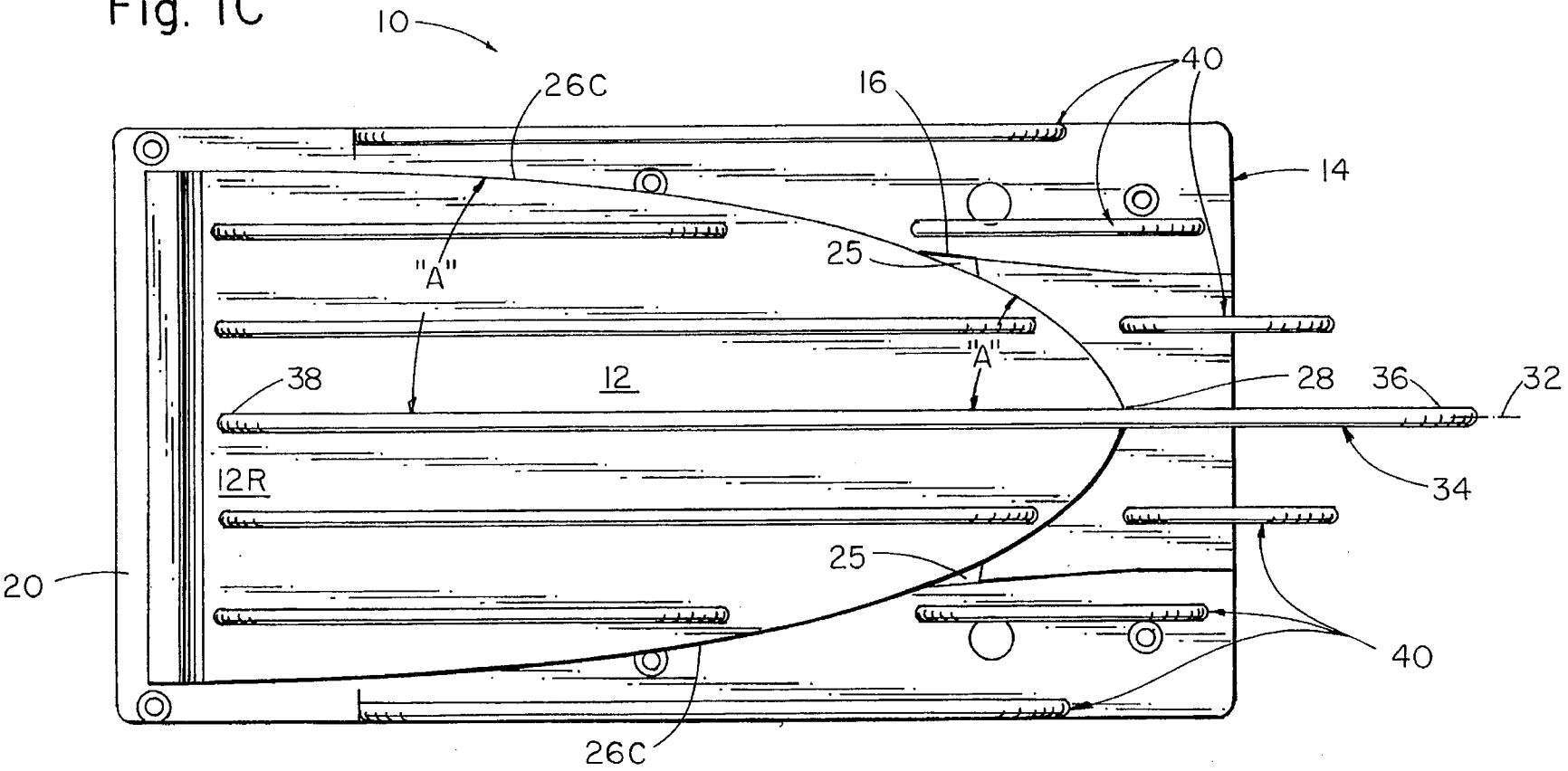
FIG. 1C is a bottom plan view of the third embodiment of the exclusion plate wherein the exclusion plate comprises a generally curved-side configuration.
Figure 2:
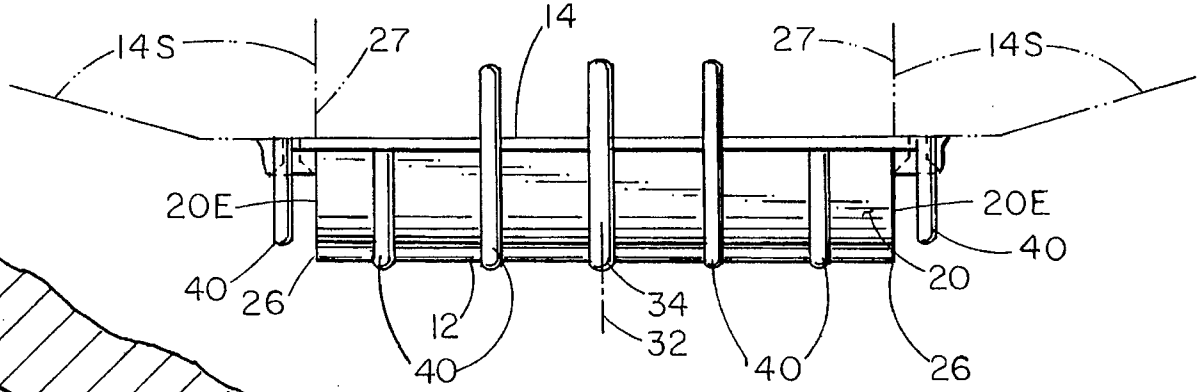
FIG. 2 is a front view of FIG. 1 illustrating the exclusion plate in its spaced apart position from the ride plate and illustrating the equidistant spacing of the fins.
Figure 3:
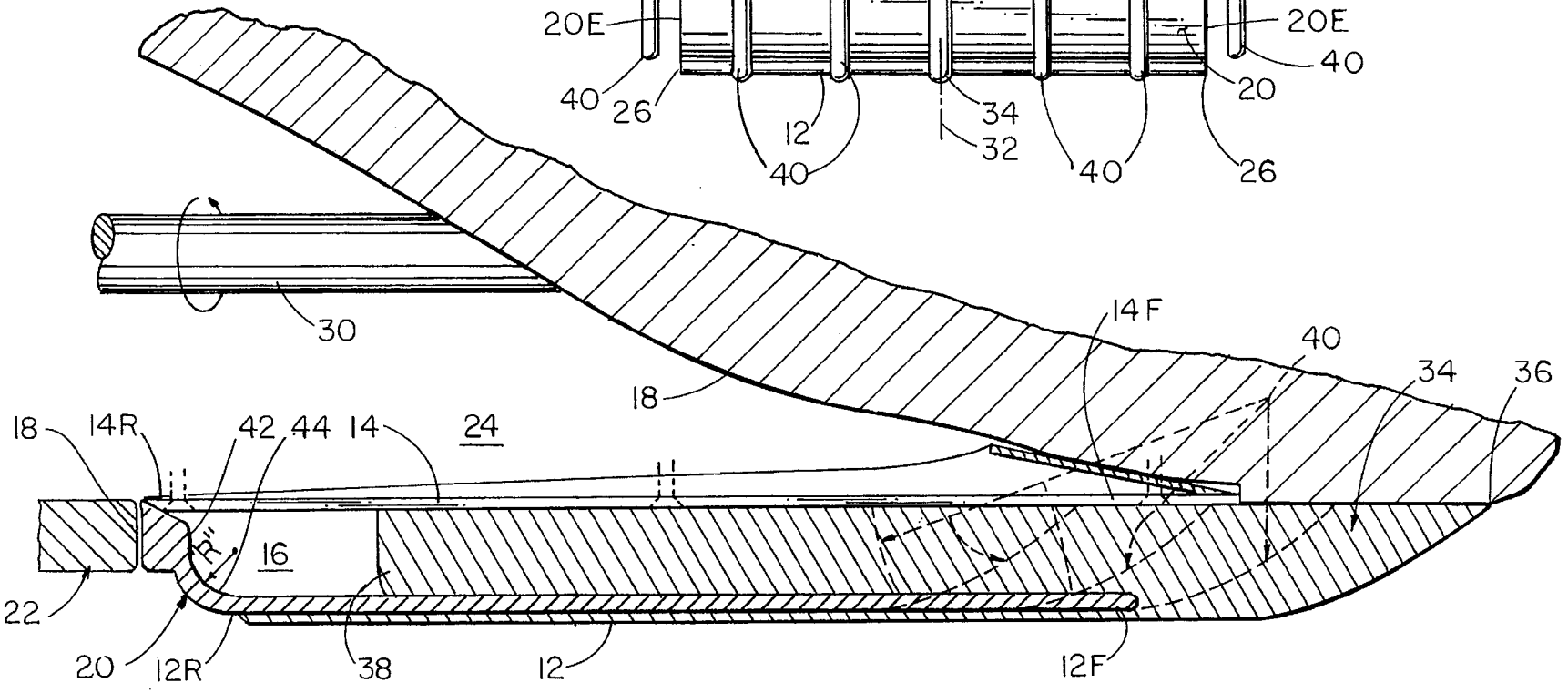
FIG. 3 is a partial cross-sectional view of FIG. 1 along lines 3—3 illustrating the downstream end of the exclusion plate connected to the ride plate such that the exclusion plate extends substantially parallel to, and spaced apart from, the ride plate.

More particularly, as shown in FIGS. 1–3, in the first embodiment of the device 10 of the invention, the exclusion plate 12 is coupled in a spaced-apart configuration parallel to the ride plate 14 (see FIG. 2) by means of a rear plate 20 (see FIG. 3). The exclusion plate 12 comprises s forward portion 12F and opposing side portions 12S. The edges 26 of the forward and side portions 12F & 12S of the exclusion plate 12 are positioned spaced apart from the respective edges 27 of the forward portion 14F and opposing side portions 14S of the ride plate 14. Coupling means 20 join the rearward portions 12R and 14R of the exclusion plate 12 and the ride plate 14 together with transverse edge 20E extending between them. Edges 26, 27 and 20E define an opening 25 for the flow of water into the intake port 18.

As best shown in FIGS. 1A, 1B, 1C, there exists several embodiments of the exclusion plate 12. More particularly, as shown in FIG. 1A, the first embodiment of the exclusion plate 12 comprises a generally triangular-shaped configuration having arcuate side edges 26A that extend from apex 28 to the rear plate 20. In another embodiment as shown in FIG. 1B, the exclusion plate 12 may comprise a triangular-shaped configuration with straight side edges 26S extending from apex 28. Further, in still another embodiment as shown in FIG. 1C, the exclusion plate 12 may comprise a generally U-shaped configuration with curved side edges 26C extending from apex 28. It is noted that functionally, the side edges 26 of the exclusion plate 12 are configured and dimensioned for each particular application such that debris, particularly fibrous debris such as seaweed, is forced rearwardly along the side edges 26 during water flow into the intake 24 of the jet drive. Consequently, it should be appreciated that the angle "A" of all the points along the side edges 26 measured from the apex 28 to the longitudinal axis 32 of the exclusion device 10 cannot be ninety degrees or greater and, preferably, is significantly less than ninety degrees, such as forty-five degrees or less. Toward the rear of the exclusion plate 12, the angle "A" is close to zero degrees (i.e., parallel) at the point adjacent the rear plate 20. Hence, the terms "arcuate," "straight" and "curved" used to describe the side edges 26A, 26S, 26C, respectively, are intended to define the peripheral edge configuration of the opposing side portions 12S of the exclusion plate 12 in a broad manner, with the particular shape of the side edges 26, and the angle formed with the longitudinal axis 32, being more precisely defined for each particular jet drive 30 to which the exclusion device 10 of the invention is applied. It is noted, however, that generally the faster the watercraft 22 is intended to operate, the greater the angle "A" of the side edges 26 may be (e.g., FIG. 1C) whereas the slower the watercraft 22 is intended to operate, the side edges 26 should be of a shallower angle (e.g., FIG. 1B). FIG. 1A illustrates what is presently regarded as the optimal angle for the sides 26A when the exclusion device 10 of the invention is used in connection with a conventional personal watercraft that typically operates at a speed of 30 to 40 miles per hour.

As best shown in FIG. 3, coupling means 20 such as a rear plate of the first embodiment of the exclusion device 10 of the invention functions to rigidly couple the rearward portion 12R of the exclusion plate 12 with the rearward portion 14R of the ride plate 14 such that the exclusion plate 12 is rigidly positioned in a spaced-apart manner from the intake hole 16 of the ride plate 14 as described hereinabove. Rear plate 20 preferably includes a straight portion 42 and a curved portion 44. The straight portion 42 is rigidly coupled to the rearward portion 14R of the ride plate 14 by means of welding, fastening, or integrally molding or forming them together.

Preferably, curved portion 44 of the rear plate 20 is formed at a radius "R" that is approximately equal to one-half of the distance "D" between the exclusion plate 12 and the outward surface of the ride plate 14. It is noted that for larger radiuses "R", the smaller the straight portion 42 becomes, thereby providing a smoother surface for the flow of water into the intake 24.

As best shown in FIG. 2, the first embodiment of the jet drive exclusion device 10 of the invention preferably comprises a transverse center web 34 positioned transverse to the exclusion plate 12 from a point 36 forward of the ride plate 14 to a point 38 at the rearward portion 12R of the exclusion plate 12 in a position proximate to the rear plate 20 (see also FIG. 3). Most preferably, center web 34 is positioned along the longitudinal axis 32 of the exclusion device 10. Functionally, the transverse center web 34 functions as a means for rigidly interconnecting the forward portion 12F of the exclusion plate 12 to the forward portion 14F of the ride plate 12 to preclude the possibility of the exclusion plate 12 being forced inwardly toward the ride plate 14 in the event the watercraft 22 hits bottom or otherwise hits an obstruction. As shown in FIG. 3, the forward point 36 of the center web 34 is preferably curved at an acute angle to prevent the accumulation of any debris thereon. It is also noted that the center web 34 functions to at least partially preclude smaller debris from entering the intake 24 of the jet drive 32 via intake hole 16 and intake port 18 between the exclusion plate 12 and the ride plate 14.

Figure 4:
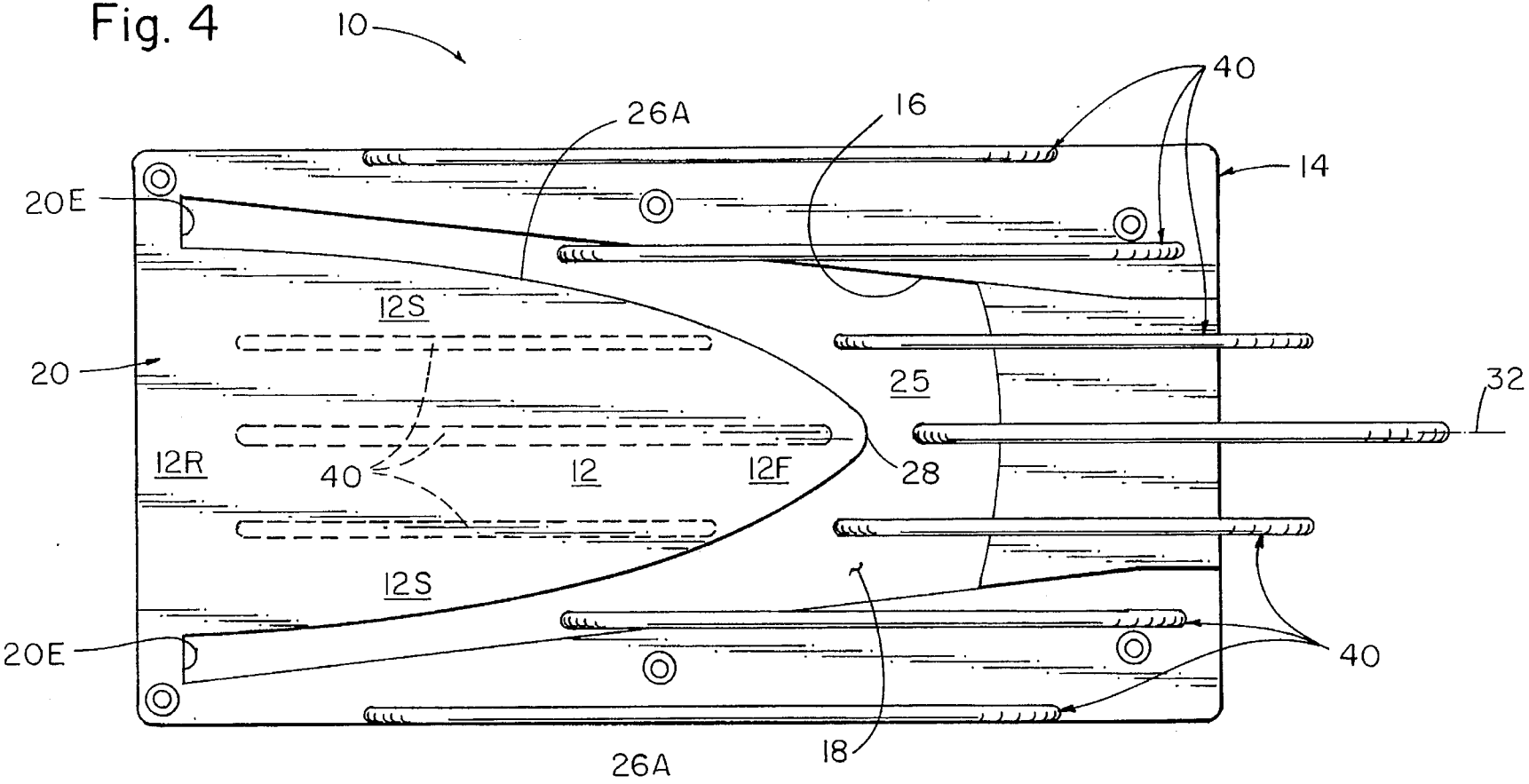
FIG. 4 is a bottom plan view of the second embodiment of the jet drive exclusion device of the invention illustrating the second embodiment of the arcuately-shaped exclusion plate mounted to, and positioned substantially planar, to the ride plate.

Turning now to the second embodiment of the exclusion device 10 of the invention as shown in FIG. 4, it is seen that the exclusion plate 12 is positioned substantially co-planar with the ride plate 14 within the intake hole 16 thereof. The rearward portion 12 of the exclusion plate 12 is rigidly coupled to the rearward portion 14R of the ride plate 14 by means of welding, fastening, or integrally molding or forming the rearward portions 12R and 14R together. This second embodiment resembles the configuration of a shark's mouth and is more streamlined than the first embodiment of the exclusion device 10 of the invention. However, it is noted that the opening 25 formed between the side edges 26 of the side portions 12S of the exclusion plate 12 and the respective edges of the intake hole 16 of the ride plate 14 is preferably greater than what is illustrated in the first embodiment of the device 10 so as to assure a substantial flow of water into the intake port 18 of the jet drive 30.

Both embodiments of the jet drive exclusion device 10 may include a plurality of lateral fins 40 so as to further preclude even smaller debris from entering through opening 25 into the intake 24 of the jet drive 30. As shown in connection with the first embodiment of the device 10, the lateral fins 40 may be utilized in addition to the center web 34 as described above, and are preferably placed exteriorly to the side and front portions 14S and 14F of the ride plate 14. In the second embodiment of the device 10, the lateral fins 40 may also be placed interiorly to the side and front portions 12S and 12F of the exclusion plate 12. In either placement, the forward portions of the lateral fins 40 are preferably curved similar to that of the center web 34 to prevent accumulation of debris thereon. Finally, it is noted that the lateral fins 40 are positioned substantially transverse to the exclusion plate 12 and the ride plate 14, and substantially parallel to the longitudinal axis 32 of the exclusion device 10 so as to enhance water flow into the opening 25.

Figure 5C:
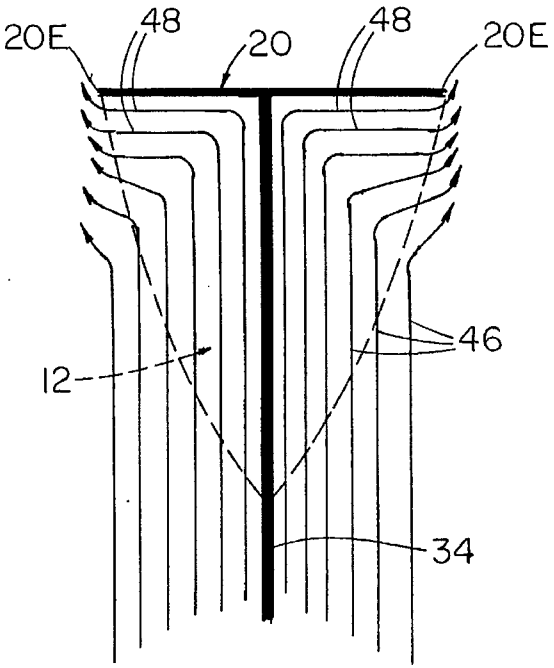
FIGS. 5A, 5B and 5C are flow diagrams illustrating the flow of water into the intake port of the jet drive and illustrating the backflow of intake water that is exhausted from the intake port at high speeds (FIG. 5C) that washes away any debris that may have accumulated at the rearward portion of the exclusion plate during slower speeds.
Figure 5B:
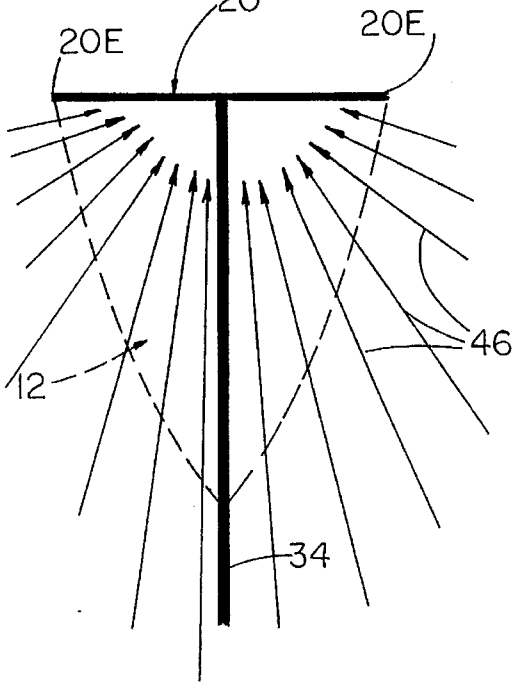
Figure 5A:
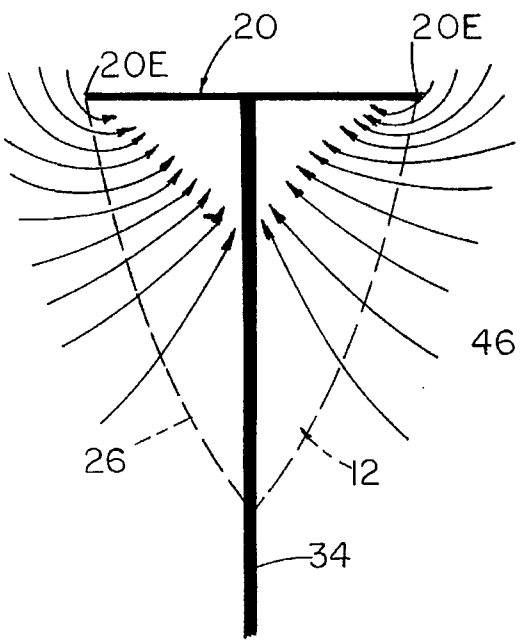

FIGS. 5A, 5B and 5C illustrate, for both embodiments of the device 10, the pattern of the flow of water through intake hole 16 into the intake port 18 and then into the intake 24 of the jet drive 30 while the watercraft 22 is at rest, at slow speed, and at high speed, respectively. At rest as shown in FIG. 5A, it is seen that water (represented by arrows 46) simply flows into the opening 25, through intake hole 16 and intake port 18 into the intake 24. It is noted that at rest, there may be some accumulation of debris at the transverse edge 20E, particularly in view of the fact that the water 26 is flowing around the edge 20E.

As shown in FIG. 5B, at the slow speeds, water 46 flows more directly into the intake 24 and therefore there is minimal water flow around the edge 20E as occurs at rest (see FIG. 5A). Accordingly, accumulation of debris is less significant. Notwithstanding, it is noted that whether the watercraft is at rest or underway at slow speeds, the accumulation of debris at the edges 20E is not significant from a practical standpoint and therefore, the fact that there is some accumulation does not adversely affect the operation of the exclusion device 10 of the invention.

As shown in FIG. 5C, at high speed operation of the watercraft 22, there is more water flow 46 into the intake 24 than can be used by the jet drive 30 of the watercraft 22. Accordingly, a positive pressure is created interiorly of the exclusion plate 12 and causes a significant portion of the water flow 46 to be forced laterally as shown by arrows 48 along the rearward portion 12R of the exclusion plate 12 and out of opening 25 and then across the edge 20E. The lateral flow 48 along the rearward portion 12R of the exclusion plate 12 has the effect of washing away any debris that may have accumulated at the edge 20E during slow or idle speeds. Importantly, the faster the watercraft 22, the more water 48 is exhausted past the edge 20E, thereby assuring that any prior accumulation is fully washed away while also assuring that no additional accumulation occurs at such high speed.

It is noted that the jet drive exclusion device 10 of the invention may be designed for custom retro-fit onto an existing jet drive watercraft 22 such as personal watercraft by simply configuring the ride plate 14 of the device 10 to replace the existing ride plate of the watercraft 22. Also, it should be apparent that the jet drive exclusion device 10 of the invention may be incorporated into specially-designed jet drive watercraft 22 and in such applications, the exclusion device 10 may be configured to be substantially flush with the bottom of the watercraft 22 or even positioned within a tunnel drive. Finally, it is noted that the jet drive exclusion device 10 of the invention may be used in conjunction with any jet drive intake 24, whether or not such intake 24 is positioned on the bottom or sides of the hull of the watercraft 22.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A debris exclusion device for excluding debris from the jet intake of a jet drive of a watercraft, the jet intake having an opening defined by front, rear and opposing side portions, the debris exclusion device comprising in combination:

a non-articulated exclusion plate having a forward portion, a rearward portion and opposing side portions; and means for coupling said rearward portion of said exclusion plate relative to a rearward portion of the intake of the jet drive such that said exclusion plate is positioned about the intake of the jet drive with said forward portion and said side portions of said exclusion plate being positioned spaced apart from the forward and the side portions of the jet intake, respectively, allowing water flow therebetween, whereby, upon operation of the jet drive and forward movement of the watercraft, a positive pressure is created interiorly of said exclusion plate that produces a flow of water about said coupling means thereby precluding an accumulation of debris about said coupling means.

2. The exclusion device as set forth in claim 1, wherein said coupling means comprising means for coupling said rearward portion of said exclusion plate relative to the rearward portion of the jet intake to define a transverse edge extending from said exclusion plate across the opening of the jet intake with the flow of water flowing about said transverse edge.

3. The exclusion device as set forth in claim 2, wherein said exclusion plate is positioned substantially parallel to and offset from the opening of the jet intake.

4. The exclusion device as set forth in claim 3, wherein said forward portion of said exclusion plate comprises an apex portion and wherein said side portions of said exclusion plate comprise substantially curved configurations.

5. The exclusion device as set forth in claim 3, wherein said forward portion of said exclusion plate comprises an apex portion and wherein said side portions of said exclusion plate comprise substantially arcuate configurations.

6. The exclusion device as set forth in claim 3, wherein said forward portion of said exclusion plate comprises an apex portion and wherein said side portions of said exclusion plate comprise substantially straight configurations.

7. The exclusion device as set forth in claim 3, further comprising a center web connected between said exclusion plate and the opening of the jet intake.

8. The exclusion device as set forth in claim 3, further comprising at least one lateral fin positioned forwardly of said exclusion plate.

9. The exclusion device as set forth in claim 2, wherein said exclusion plate is positioned substantially planar with the opening of the jet intake.

10. The exclusion device as set forth in claim 9, wherein said forward portion of said exclusion plate comprises an apex portion and wherein said side portions of said exclusion plate comprise substantially curved configurations.

11. The exclusion device as set forth in claim 9, wherein said forward portion of said exclusion plate comprises an apex portion and wherein said side portions of said exclusion plate comprise substantially arcuate configurations.

12. The exclusion device as set forth in claim 9, wherein said forward portion of said exclusion plate comprises an apex portion and wherein said side portions of said exclusion plate comprise substantially straight configurations.

13. The exclusion device as set forth in claim 9, further comprising at least one lateral fin positioned forwardly of said exclusion plate.

14. The exclusion device as set forth in claim 9, further comprising at least one lateral fin positioned interiorly of said extrusion plate.

15. A method for excluding debris from clogging an opening to an intake of a jet drive of a watercraft, comprising the steps of positioning a non-articulated exclusion plate spaced about the opening with the forward and opposing side portions thereof being spaced apart from the intake and the rearward portion being coupled to the intake and, upon operation of the jet drive and forward movement of the watercraft, producing a positive flow of water about the rearward portion, thereby precluding an accumulation of debris at the rearward portion.

* * * * *